US006167654B1

(12) United States Patent
Wolf

(10) Patent No.: US 6,167,654 B1
(45) Date of Patent: Jan. 2, 2001

(54) DEVICE FOR OPERATING HINGED OR GUIDED CLOSURES

(76) Inventor: Michael Wolf, Sichererstrasse 9, D-74076 Heilbronn (DE)

( * ) Notice: Under 35 U.S.C. 154(b), the term of this patent shall be extended for 0 days.

(21) Appl. No.: 08/945,002

(22) PCT Filed: Apr. 15, 1996

(86) PCT No.: PCT/DE96/00651

§ 371 Date: Dec. 24, 1997

§ 102(e) Date: Dec. 24, 1997

(87) PCT Pub. No.: WO96/32558

PCT Pub. Date: Oct. 17, 1996

(30) Foreign Application Priority Data

Apr. 13, 1995 (DE) ..... 195 13 484
Feb. 20, 1996 (DE) ..... 196 06 131

(51) Int. Cl.[7] ..... E05F 11/00; E05F 11/04; E05F 3/00

(52) U.S. Cl. ..... 49/357; 49/324; 49/379; 49/347; 16/63; 16/85

(58) Field of Search ..... 49/379, 357, 364, 49/324, 347, 325, 358, 503, 31, 279; 16/85, 64, 63

(56) References Cited

U.S. PATENT DOCUMENTS

| | | | | |
|---|---|---|---|---|
| 1,932,339 | * | 10/1933 | Garratt | 49/279 |
| 3,332,638 | * | 7/1967 | Jessup et al. | 16/63 |
| 3,502,280 | | 3/1970 | Jessup et al. . | |
| 4,609,910 | * | 9/1986 | Geringer et al. | 49/31 |

FOREIGN PATENT DOCUMENTS

| | | |
|---|---|---|
| 16 489 | 8/1898 | (CH) . |
| 127 236 | 5/1901 | (DE) . |
| 66 03 354 | 9/1969 | (DE) . |
| 26 00 396 | 7/1976 | (DE) . |
| 25 43 602 | 4/1977 | (DE) . |
| 31 17 193 A1 | 11/1982 | (DE) . |
| 31 48 481 A1 | 6/1983 | (DE) . |
| 83 09 287 | 8/1983 | (DE) . |
| 36 04 083 A1 | 8/1987 | (DE) . |
| 87 15 737 | 5/1988 | (DE) . |
| 0 099 223 | 1/1984 | (EP) . |
| 01 20 489 A2 | 3/1984 | (EP) . |
| 0 384 141 | 1/1990 | (EP) . |
| 24 91 982 A1 | 10/1980 | (FR) . |

OTHER PUBLICATIONS

Rabe, Kurt, Verschlüsse und Schlösser. Fachbuchverlag GmbH, Leipzig, S. 11,12 (No Date Available).

* cited by examiner

*Primary Examiner*—Daniel P. Stodola
*Assistant Examiner*—Hugh B. Thompson
(74) *Attorney, Agent, or Firm*—Boyle Fredrickson Newholm Stein & Gratz S.C.

(57) ABSTRACT

A device for automatically closing a closure installation (such as a window or a door) includes a drive device, a traction mechanism, a spring, an actuating device and a locking device. The closure installation is mounted in a frame supported by a building. The traction mechanism is located between the closure installation and the frame, and is driven by the drive device to close the closure installation. The spring is tensioned when the closure installation is placed in the open position, and supplies the energy to the drive device which is required to close the closure installation. The actuating device is used to initially place the closure installation in the open position. The actuating device tensions the spring when the closure installation is placed in the open position. The locking device is initially released to permit the closure installation to be placed in the open position. After the closure installation is closed, the locking device automatically locks the closure installation to the frame in the closed position.

14 Claims, 1 Drawing Sheet

DEVICE FOR OPERATING HINGED OR GUIDED CLOSURES

BACKGROUND OF THE INVENTION

1. Field of the Invention

The invention relates to a device for operating linked and guided closure installations such as windows, doors, flaps, screens or sliding panels.

2. Description of the Related Art

Closure devices already exist, operating by means of a sliding arm, one end of which is connected to the door by a swiveling link, while the other end is free to slide vertically in a guide rail on the door frame. Such door closure devices close the door when the force used to open it is withdrawn, for example, if the person opening the door releases it. This occurs immediately. No delay is envisaged between the withdrawal of the force and the closure of the door. The closure device consists of several parts, and is of a complicated construction.

Devices powered by an electric motor are also used for closing doors and windows. Time switches installed in the current/voltage circuit of the electric motor can be used to set the time at which the window or door should be opened or closed. One disadvantage of such closure devices is that they are expensive to buy, and also that they require a considerable amount of electricity, and thus have a high energy consumption.

SUMMARY OF THE INVENTION

The present invention provides a device which overcomes these drawbacks. Specifically, a device according to the present invention has the advantage that the closure device is connected by way of a traction mechanism to the frame of the closure device set in the wall, and that the traction mechanism can be coiled around a shaft, which operates on the closure device by means of a spring. An adjusting device on the shaft is used to adjust the force exerted by the spring on the traction mechanism. When the closed position has been reached, the closure device is locked onto the frame by means of a bar. Utilizing the force exerted, and the proportional relationship, it is possible to adjust the acceleration of the closing device during closing that is produced by the traction mechanism. The smaller the force, the less the acceleration, thus producing, the speed of closure accordingly. Consequently, the force of the spring, transmitted to the closing device by the traction mechanism, can be used to adjust the speed of closure.

One advantage of the device is its relatively simple construction, consisting of only a few parts. This means that its manufacture and installation are simple and inexpensive to perform. The device is of a purely mechanical construction, requiring no electrical power whatsoever. The closure device has many applications. For example, it can be installed on various types of closure installations such as windows, doors, flaps, screens or sliding panels. The closure device is also simple to operate.

A further advantage of the invention is realized when the closure installation consists of a swiveling window, turning on a horizontal axis in one position, for example, a window in a toilet, bathroom, living room, bedroom or office, or a swiveling skylight. When the window is opened, this causes the spring attached to the shaft to be released. The ensuing force of the spring ensures that the window automatically closes again, within the time selected on the adjustment device. This eliminates the risk of a previously opened window remaining inadvertently open over a longer period, which could allow access to burglars, or, during bad weather, penetration by cold air, rain or snow. In the case of heated rooms in particular, a window left inadvertently open for an extended period of time allows cold air to flow in, causing the heating system controlled by a thermostat inside the room to turn up the heat. The advantage of the closing device represented by this invention is that the window is automatically closed after a predetermined time, thus minimizing the amount of energy consumed by the heating system. This in turn reduces heating costs and helps to protect the environment.

A further advantage of the invention is that the traction mechanism preferably consists of a pull rope.

Other advantages and advantageous design features of the invention can be seen from the following description, the drawing, and the claims.

BRIEF DESCRIPTION OF THE DRAWINGS

The drawings illustrate an embodiment of the closing device represented by this invention, as described below.

DETAILED DESCRIPTION OF THE PREFERRED EMBODIMENT

Figure 1:
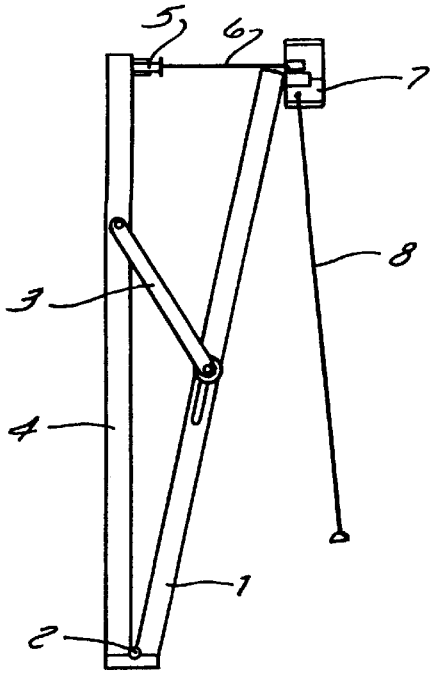
FIG. 1 illustrates a side view of a window in the tilted position, with the closing device.

FIG. 1 illustrates a window 1 that pivots on a horizontal axis 2, held in a tilted position by a retaining strap or strut 3 linking the window 1 and window frame 4. The pull rope 6 is attached to the window frame 4 A closing device for automatically closing the window 1 preferably includes a drive device 7, a spring 10, a traction mechanism such as a pull rope 6, an actuating device such as a cord 8, a locking device such as a bar 12, and a timing element 18 by a hook 5, and connected to the closing device 7 on the window. A cord 8 is used to open the window and to release the catch in the closing device 7. The catch is not visible in FIG. 1.

Figure 2:
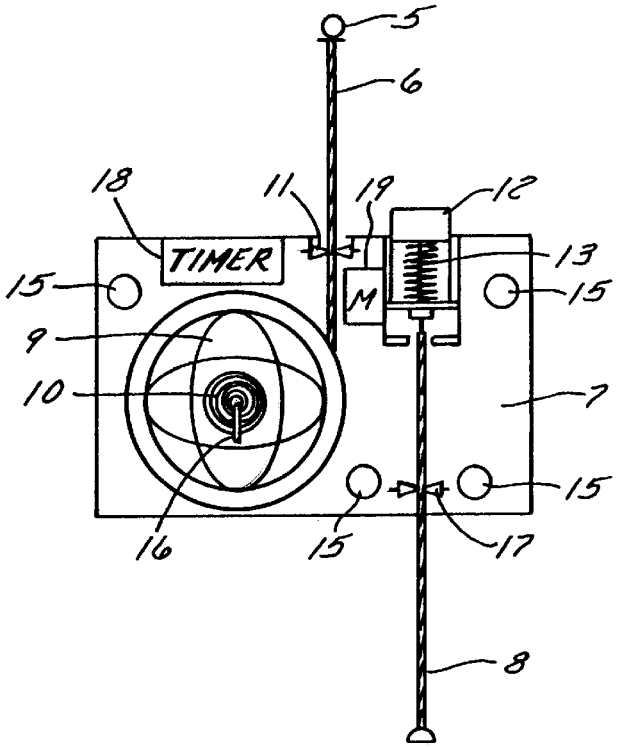
FIG. 2 is a diagram showing the closing device referred to in FIG. 1, viewed from above.

FIG. 2 illustrates the closing device 7 with the pull rope 6 and cord 8 as seen from above. The pull rope 6 is led over a deflecting pulley in the closing device, one end of the pull rope being attached to a spindle 9, which is itself linked to a spring 10. The spring supplies stored energy for the drive device 7 during the closing operation to close the window 1. The pull rope 6 and the cord 8 cooperate to tension the spring 10 as the window 1 is placed in the open position. Thus, a pulling motion applied to the cord 8 simultaneously tensions the spring 10 and places the window 1 in the open position. When the window is opened, part of the pull rope 6 is tensioned by the spindle 9. This enables the spindle 9 upon commencement of window closure to rotate, releasing the spring 10. The resultant force of the spring acts on the spindle 9, causing it to turn in the opposite direction, so that the pull rope 6 is rewound around the spindle 9. Because a virtually linear relationship between the force of the spring and the released pull rope is created, the spring is pretensioned in the starting position when the window is closed. The commencement of the closing operation may be controlled by a timing element, such as an adjustable time switch 18 (shown schematically in FIG. 2), installed in the drive device 7. An externally adjustable brake 16 is placed between the spring and the spindle. This is used to adjust the rate of acceleration with which the spring drives the spindle. This rate of acceleration determines the speed at which the window closes. Because the force is also transmitted to the deflecting pulley 11 through the pull rope, this is well mounted and of robust construction. To keep energy losses to a minimum, the deflecting pulley is relatively large with a considerable dead weight. A ring is attached to the end of the pull rope nearest the window, preventing the loose pull rope from being drawn into the closing device. The spring 13 is used to push the bar 12 into position in order to lock the window. The bar 12 is released by pulling a cord 8, which is led over a deflecting pulley 17, enabling the window to be opened. An electromagnet 19 (shown schematically in FIG. 2) may also be used to unlock the window remotely from a central location, for example, when multiple devices according to the invention are used with several windows simultaneously. The spring is strong enough to ensure that the bar latches correctly in the frame. It is sufficient if the force of the spring is only slightly greater than that exerted by the weight of the bar 12 and the cord 8. A plurality of such locking devices may be used at various locations on the closure installation. Circular recesses 15 are provided in order to attach the housing 14 of the closing device to the window. The method of attachment to the window must be strong enough to cope with the relatively strong forces acting on the closing device and thus on the housing too. This is ensured by the positioning of the recesses, as shown in FIG. 2.

Many other changes and modifications may be made to the present invention without departing from the spirit thereof. The scope of these and other changes will become apparent from the appended claims.

What is claimed is:

1. A device for automatically closing a window which is initially placed an open position, the closing of the window during a closing operation placing the window in a closed position, the window being mounted in a frame supported by a building, the device comprising:

a drive device, the drive device including a spring, the spring being adapted to be tensioned when the window is placed in the open position, the spring being adapted to supply stored energy for automatically closing the window during the closing operation to close the window, a traction mechanism, the traction mechanism being adapted to be located between the window and the frame, the traction mechanism being configured to be driven by the drive device to automatically close the window during the closing operation, an actuating device, the actuating device being movable between a deactuated position and an actuated position and being adapted to open the window during said movement, wherein the actuating device is coupled to the traction mechanism such that movement of the actuating device from the deactuated position to the actuated position drives the traction mechanism to tension the spring, whereby a pulling motion applied to the actuating device simultaneously tensions the spring and is adapted to place the window in the open position, a locking device, the locking device initially being released by the actuating device and adapted to permit the window to be placed in the open position, and the locking device automatically being adapted to lock the window to the frame in the closed position after the window is closed, and a timing element, the timing element being installed in the drive device, the timing element being adapted to control the timing of commencement of the automatic closure of the window.

2. A device according to claim 1, wherein the drive device is configured to be installed on the window.

3. A device according to claim 1, wherein the drive device includes a shaft that cooperates with the traction mechanism, the shaft being driven by the spring.

4. A device according to claim 1, wherein the drive device is adapted to act upon an upper portion of a window that tilts and that is mounted on a horizontal pivoting point.

5. A device according to claim 1, wherein the traction mechanism comprises a pull rope.

6. A device according to claim 1, wherein the actuating device comprises a rope from the drive device.

7. A device according to claim 1, wherein the timing element is adjustable.

8. A device according to claim 1, further comprising a stopping device, the stopping device permitting the drive device to be deactivated.

9. A device according to claim 1, wherein the spring controls the speed with which the closing operation is performed.

10. A device according to claim 1, wherein the spring is a tension spring, and is disposed in a cavity of the frame.

11. A device according to claim 1, further comprising a retaining strap, the retaining strap being adapted to be disposed between the window and the frame, the retaining strap being engaged by the drive device.

12. A device according to claim 1, further comprising a release mechanism, the release mechanism being configured to permit the locking device to be unlocked after the window is locked in the closed position.

13. A device according to claim 1, further comprising a plurality of locking devices, the plurality of locking devices being adapted to be placed at various locations on the window.

14. A device according to claim 1, further comprising an electromagnet, the electromagnet being configured to permit the locking device to be unlocked remotely after the window is locked in the closed position.

* * * * *